US008248291B2

(12) United States Patent
Kao

(10) Patent No.: US 8,248,291 B2
(45) Date of Patent: Aug. 21, 2012

(54) ELECTRONIC APPARATUS WITH REMOTE CONTROL FUNCTIONS

(75) Inventor: Peng-Feng Kao, Taipei County (TW)

(73) Assignee: Princeton Technology Corporation, HsinTien, Taipei County (TW)

( * ) Notice: Subject to any disclaimer, the term of this patent is extended or adjusted under 35 U.S.C. 154(b) by 470 days.

(21) Appl. No.: 12/434,879

(22) Filed: May 4, 2009

(65) Prior Publication Data

US 2009/0278724 A1 Nov. 12, 2009

(30) Foreign Application Priority Data

May 9, 2008 (TW) ..... 97117140 A

(51) Int. Cl.
*G08C 19/00* (2006.01)

(52) U.S. Cl. ..... 341/176; 341/173; 341/177

(58) Field of Classification Search ..... 341/176, 341/173, 177
See application file for complete search history.

(56) References Cited

U.S. PATENT DOCUMENTS 5,963,624 A * 10/1999 Pope ..... 379/110.01
2004/0027495 A1* 2/2004 Ferris ..... 348/734

* cited by examiner

*Primary Examiner* — Hal Kaplan
(74) *Attorney, Agent, or Firm* — Muncy, Geissler, Olds & Lowe, PLLC

(57) ABSTRACT

An electronic apparatus with remote control functions including an operating module, a control module and a transmitting module is disclosed. The operating module generates at least one operating signal. The control module is coupled to the operating module and generates at least one first control signal and at least one second control signal according to the operating signal. The transmitting module is coupled to the control module and transmits the first control signal and the second control signal. The first control signal is within a first frequency range, and the second control signal is within a second frequency range.

15 Claims, 1 Drawing Sheet

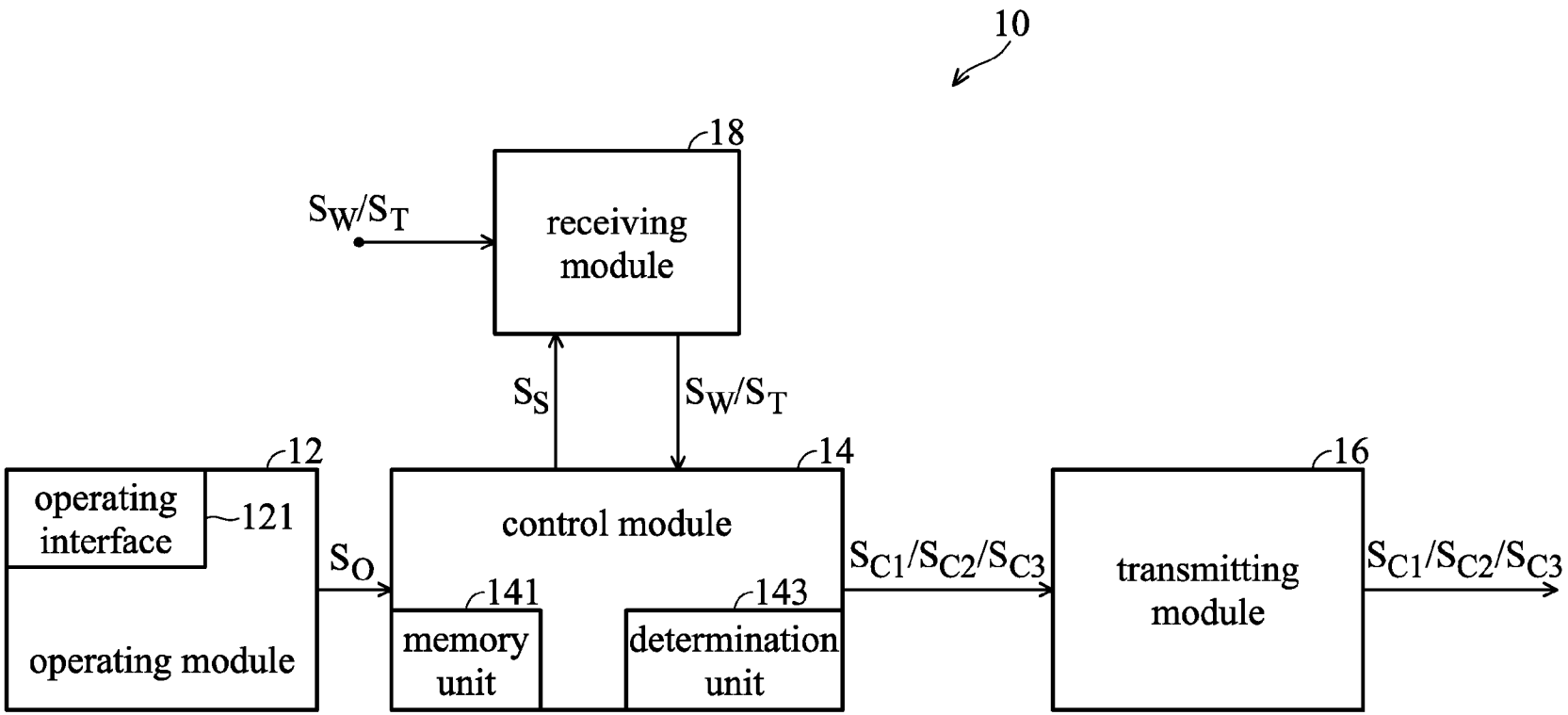
10
18
receiving module
$S_W/S_T$
$S_W/S_T$
$S_S$
14
control module
143
determination unit
141
memory unit
$S_{C1}/S_{C2}/S_{C3}$
$S_O$
12
121
operating interface
operating module
16
transmitting module
$S_{C1}/S_{C2}/S_{C3}$

ELECTRONIC APPARATUS WITH REMOTE CONTROL FUNCTIONS

This Application claims priority of Taiwan Patent Application No. 97117140, filed on May, 09, 2008, the entirety of which is incorporated by reference herein.

BACKGROUND OF THE INVENTION

1. Field of the Invention

The invention relates generally to an electronic apparatus, and more particularly, to an electronic apparatus that integrates remote control functions therein.

2. Description of the Related Art

Driven by continued development of technology, most electronic products are equipped with a wireless remote control function for manipulation convenience. With the use of remote controls, users can more easily manipulate the electronic products without frequent physical movement, thus significantly reducing inconvenience. However, every kind of electronic product has its own dedicated frequency which is different from the other. Therefore, dedicated remote controls are required in order to transmit appropriate remote control signals with corresponding operating frequency range while using different electronic products. Thus, making it very inconvenient for users, as more and more electronic products are being equipped with wireless remote control functions because users need more remote controllers in response to various electronic products with different operating frequencies.

Therefore, integrating various remote controls to improve the convenience of user has become an important issue among manufacturers.

BRIEF SUMMARY OF THE INVENTION

In light of the previously described, the objective of the invention is to provide an electronic apparatus that integrates remote control functions therein, thereby improving user convenience and solving the problems known in the prior art.

An electronic apparatus with remote control functions comprising an operating module, a control module and a transmitting module is disclosed. The operating module generates at least an operating signal. The control module is coupled to the operating module and generates at least a first control signal and at least a second control signal according to the operating signal. The transmitting module is coupled to the control module and transmits the first control signal and the second control signal, wherein the first control signal is within a first frequency range, and the second control signal is within a second frequency range.

BRIEF DESCRIPTION OF THE DRAWINGS

The invention can be more fully understood by reading the subsequent detailed description and examples with references made to the accompanying drawings, wherein:

FIG. 1 shows a diagram of an electronic apparatus with remote control functions according to present invention.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Referring to FIG. 1, a diagram of an electronic apparatus with remote control functions is shown according to present invention. As shown in FIG. 1, the electronic apparatus 10 with remote control functions comprises an operating module 12, a control module 14 and a transmitting module 16. The operating module 12 is used to generate at least an operating signal $S_0$. The control module 14 is coupled to the operating module 12 and generates at least a first control signal $S_{C1}$ and at least a second control signal $S_{C2}$ according to the operating signal $S_0$. The transmitting module 16 is coupled to the control module 14 and transmits the first control signal $S_{C1}$ and the second control signal $S_{C2}$, wherein the first control signal $S_{C1}$ is within a first frequency range, and the second control signal $S_{C2}$ is within a second frequency range. The electronic apparatus 10 is a portable electronic apparatus. In one embodiment, the portable electronic apparatus is a cell phone.

In addition, the operating module 12 further comprises an operating interface 121 for user operation to generate the operating signal $S_0$. In one embodiment, the operating interface 121 represents a plurality of keys of a cell phone.

The control module 14 comprises a memory unit 141 coupled to the operating module 12. The memory unit 141 stores a plurality of data sets. The control module 14 generates the first control signal $S_{C1}$ and the second control signal $S_{C2}$ according to the operating signal $S_0$ and the data sets.

The data sets comprise a plurality of operating signals $S_0$ individually corresponding to the first control signal $S_{C1}$ or second control signal $S_{C2}$ for each operating signal $S_0$. In one embodiment, the data sets are stored in a table, and the control module 14 locates the corresponding first control signal $S_{C1}$ or second control signal $S_{C2}$ in a table-lookup manner based on the operating signal $S_0$.

The control module 14 further comprises a determination unit 143 for determining whether the memory unit 141 has the corresponding first control signal $S_{C1}$ or second control signal $S_{C2}$ when receiving at least an operating signal $S_0$. If the determination unit 143 determines that the data sets stored in the memory unit 141 have the corresponding first control signal $S_{C1}$ or second control signal $S_{C2}$ for the operating signal $S_0$, the determination unit 143 controls the control module 14 to transmit the first control signal $S_{C1}$ or second control signal $S_{C2}$ to the transmitting module 16.

If the determination unit 143 determines that the data sets stored in the memory unit 141 do not have the first control signal $S_{C1}$ or second control signal $S_{C2}$ for the operating signal $S_0$, the determination unit 143 generates a setting signal $S_S$. Furthermore, the electronic apparatus 10 further comprises a receiving module 18 coupled to the control module 14. The receiving module 18 is used to receive an external signal $S_W$ and transmit the external signal $S_W$ to the memory unit 141 when setting signal $S_S$ is provided from the control module 14. The memory unit 141 further stores the external signal $S_W$ and the operating signal $S_0$ after receiving the external signal $S_W$.

In this embodiment, the determination unit 143 is used to determine whether the memory unit 141 has the operating signal $S_0$ issued from the operating module 12 and the corresponding first control signal $S_{C1}$ or second control signal $S_{C2}$. If so, the procedure continues. If not, the external signal $S_W$ is received through the receiving module 18, and the new data set is added to the memory unit 141 for future use. In this manner, the remote control signals of desired electronic products can be newly added to the electronic apparatus 10 according to the need of users, thus providing for improved convenience.

Furthermore, the receiving module 18 further receives at least a communication signal $S_T$ and transmits the communication signal $S_T$ to the control module 14, and the control module 14 generates at least a third control signal $S_{C3}$ according to the communication signal $S_T$. The frequency of the third control signal $S_{C3}$ is approximately the same as the second control signal $S_{C2}$. In this embodiment, because the frequency of the third control signal $S_{C3}$ is approximately the same as the second control signal $S_{C2}$, and the first control signal $S_{C1}$ and the second control signal $S_{C2}$ are within different frequency ranges, the first control signal $S_{C1}$ and the third control signal $S_{C3}$ can be transmitted at the same time by the transmitting module 16. In one embodiment, the first control signal $S_{C1}$ is the wireless signal transmitted from conventional remote controls, which are typically infrared signals within a lower frequency range. The second control signal $S_{C2}$ includes a dial signal from conventional cell phones, and the third control signal $S_{C3}$ includes the communication signal during a call. Meanwhile, the second control signal $S_{C2}$ and the third control signal $S_{C3}$ have an analogous frequency range higher than that of the first control signal $S_{C1}$.

Because the first control signal $S_{C1}$ and the third control signal $S_{C3}$ have different operating frequency ranges, the electronic apparatus 10 with remote control functions in the present invention both have a remote control function and a cell phone function at the same time, and those signals $S_{C1}$, $S_{C2}$ and $S_{C3}$ can be transmitted through transmitting module 16. Furthermore, because the first control signal $S_{C1}$, the second control signal $S_{C2}$ and the third control signal $S_{C3}$ are operated within two different frequency ranges, user can also use the remote control function while talking on the phone by the electronic apparatus 10 of the present invention.

As described above, the electronic apparatus with remote control functions of the present invention integrates the conventional remote controller into a cell phone and generates the different frequency first control signal (the wireless signal of remote controller), second control signal (the dial signal of cell phone) and third control signal (the communication signal during a call) through the control module. Moreover, the remote control signal and signals of the cell phone that are within different frequency ranges can be transmitted simultaneously by the transmitting module. In this manner, the remote control and cell phone can be combined together to provide improved convenience for users, thus solving the problems in the prior art.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An electronic apparatus with remote control functions, comprising:

an operating module for generating at least one operating signal;

a control module coupled to the operating module to generate at least one first control signal and at least one second control signal according to the operating signal; and a transmitting module coupled to the control module to transmit the first control signal and the second control signal, wherein the first control signal is within a first frequency range, and the second control signal is within a second frequency range which is non-overlapping with the first frequency range.

2. The electronic apparatus as claimed in claim 1, wherein the control module has a memory unit for storing a plurality of data sets, and the control module generates the first control signal and the second control signal according to the operating signal and the data sets.

3. The electronic apparatus as claimed in claim 2, wherein the data sets include a plurality of operating signals and the first control signal or the second control signal corresponding to each operating signal.

4. The electronic apparatus as claimed in claim 3, wherein the data sets are stored in a table form.

5. The electronic apparatus as claimed in claim 2, wherein the control module further comprises a determination unit for determining whether the operating signal received from the operating module having the first control signal or the second control signal which is corresponding to the operating signal and stored in the memory unit when the control module receives the operating signal.

6. The electronic apparatus as claimed in claim 5, wherein, if the determination unit determines that the first control signal or the second control signal stored in the memory unit is corresponding to the operating signal, the control module transmits the first control signal or the second control signal to the transmitting module.

7. The electronic apparatus as claimed in claim 6, wherein, if the determination unit determines that the operating signal does not correspond to the first control signal or the second control signal stored in the memory unit, the determination unit generates a setting signal.

8. The electronic apparatus as claimed in claim 7, further comprising a receiving module coupled to the control module, wherein the receiving module receives an external signal and transmits the external signal to the memory unit after receiving the setting signal.

9. The electronic apparatus as claimed in claim 8, wherein the memory unit further stores the operating signal and the external signal.

10. The electronic apparatus as claimed in claim 8, wherein the receiving module receives at least one communication signal and transmits the at least one communication signal to the control module, and the control module generates at least a third control signal according to the communication signal.

11. The electronic apparatus as claimed in claim 10, wherein the operating frequency range of the third control signal is the same as that of the second control signal.

12. The electronic apparatus as claimed in claim 1, wherein the operating module includes an operating interface for generating the operating signal.

13. The electronic apparatus as claimed in claim 12, wherein the operating interface includes a plurality of keys.

14. The electronic apparatus as claimed in claim 1, wherein the electronic apparatus includes a portable electronic apparatus.

15. The electronic apparatus as claimed in claim 14, wherein the portable electronic apparatus is a cell phone.

* * * * *